United States Patent [19]

Suman, Jr.

[11] 4,378,843

[45] Apr. 5, 1983

[54] METHOD FOR COMPLETION OF WELLS

[76] Inventor: George O. Suman, Jr., 4200 Westheimer Rd., Ste. 211, Houston, Tex. 77027

[21] Appl. No.: 233,449

[22] Filed: Feb. 11, 1981

[51] Int. Cl.[3] ..... E21B 33/13; E21B 43/04

[52] U.S. Cl. ..... 166/278; 166/187; 166/387

[58] Field of Search ..... 166/51, 187, 266, 387, 166/278, 290

[56] References Cited

U.S. PATENT DOCUMENTS

| | | | |
|---|---|---|---|
| 2,903,066 | 9/1959 | Brown | 166/187 |
| 3,362,475 | 1/1968 | Huitt et al. | 166/278 |
| 3,918,522 | 11/1975 | Suman, Jr. | 166/187 |

*Primary Examiner*—Stephen J. Novosad
*Assistant Examiner*—Joseph Falk

[57] ABSTRACT

A method of completing wells comprising:

an inflatable packer used to plug the borehole below the producing formations;

casing being run from the surface to a point above the producing formation;

the casing annulus being sealed off above the producing formation;

the producing formation being underreamed and gravel packed to improve productivity. Sealing of the casing annulus may be accomplished by conventional well cement or by a second inflatable packer. The inflatable packers used are inflated with fast hardening well cement which is retained in the packer annulus by means of a check valve so as to effect an immediate seal and anchor which is maintained during and after hardening of the cement.

8 Claims, 2 Drawing Figures

METHOD FOR COMPLETION OF WELLS

FIELD OF THE INVENTION

This invention is directed to a method of completing wells such as are typically drilled for the production of petroleum products from subsurface zones of interest. More specifically, this invention relates to an improved method of completing a well in a zone substantially above the bottom of the borehole, and provides a fast, safe and efficient method of isolating the producing formation from the rest of the borehole.

BACKGROUND OF THE INVENTION

In some instances after a well has been drilled to its total depth, it is decided for various reasons to produce from a formation much shallower than the depth drilled, requiring the circulation of cement to plug the open hole below the formation to be produced. In some cases, a good cement job is not attained, allowing dangerous and expensive communication of fluid past the cement plug to thereby risk loss of the well, loss of life and environmental pollution.

The use of an inflatable packer as taught by U.S. Pat. No. 3,918,522 improves the seal between the zones by squeezing mud from between the borehole and the resilient sleeve to effect an immediate seal which is both faster and of greater integrity than a conventional cement seal which cannot squeeze out the mud. After the producing formation has been penetrated, hydrocarbons under pressure are subject to flowing up the well bore to the surface, making every hour of rig time more dangerous thereafter. Since the inflatable packer seals immediately on inflation and since check valves maintain the sealing pressure as the cement hardens and after, a permanent seal and a faster and safer method of completions now becomes possible. The usual rig time delay caused while a conventional cement plug hardens is no longer necessary, and the next operation can proceed sooner and in greater safety than heretofore.

SUMMARY OF THE INVENTION

It is therefore a feature of the present invention to provide a novel method to isolate a producing formation from the well bore below. Another feature of this invention is to provide a safe and fast method to proceed with subsequent operations. Still another feature of this invention is to improve the productivity of the formations in a safe, fast and efficient manner.

Other and further objects, advantages and features of the invention will become obvious to one skilled in the art upon an understanding of the illustrative embodiment about to be described and various advantages, not referred to herein, will occur to one skilled in the art upon employment of the invention in practice.

The present invention is directed to the provision of a method and system for completion of wells wherein an open hole plug is set below a formation to be produced. The method includes running a string of pipe into a well bore that intersects a subsurface zone of interest wherein the pipe has an inflatable packer releasably attached thereto. The packer has a sleeve that is adapted to be expanded outwardly into anchoring and sealing relation with the open hole below the formation to be produced. The packer has a bull plug or the like attached to it to prevent flow through the interior of the packer. With the pipe and packer in place, the packer is inflated by means of well cement, causing the sleeve of the inflatable packer to expand outwardly and establish an anchored and sealing relation with the wall surfaces of the well bore. The cement within the packer is maintained under pressure by check valves internal to the packer while the cement is allowed to set to a hardened mass, thus establishing an anchor and sealing system of good integrity to seal the lower portion of the well casing to the formation surrounding it. Thus the packer assembly effectively forms a plug in the open borehole below the formation to be produced.

The running string can then be removed from the borehole and casing set above the formation to be cemented either conventionally or by using another inflatable packer attached to the casing string. The producing formation being thus sealed from the remaining well bore, by means of an inflatable packer below the zone of interest and an inflatable packer or well cement above the zone of interest and around the casing, is isolated safely and quickly so as to be produced to the surface.

Some producing formations contain particles of sand or the like that loosen and flow toward the well bore to eventually clog flowpaths in the formation adjacent the well bore to thereby reduce or prevent further production. So as to reduce or prevent clogging of flowpaths adjacent the well bore, the producing formation may be enlarged by underreaming the well bore as is well known in the art, the enlarged portion of the borehole then to be packed with gravel or the like so as to hold the wall of the enlarged portion in place. Before packing the enlarged portion with gravel, a conventional screen may be lowered on conventional production tubing so as to be at the center of the gravel packed zone to thereby receive flow from the producing formation through the gravel for producing up the tubing to conventional surface equipment.

IN THE DRAWINGS

DETAILED DESCRIPTION OF PREFERRED EMBODIMENT

Figures 1, 2:
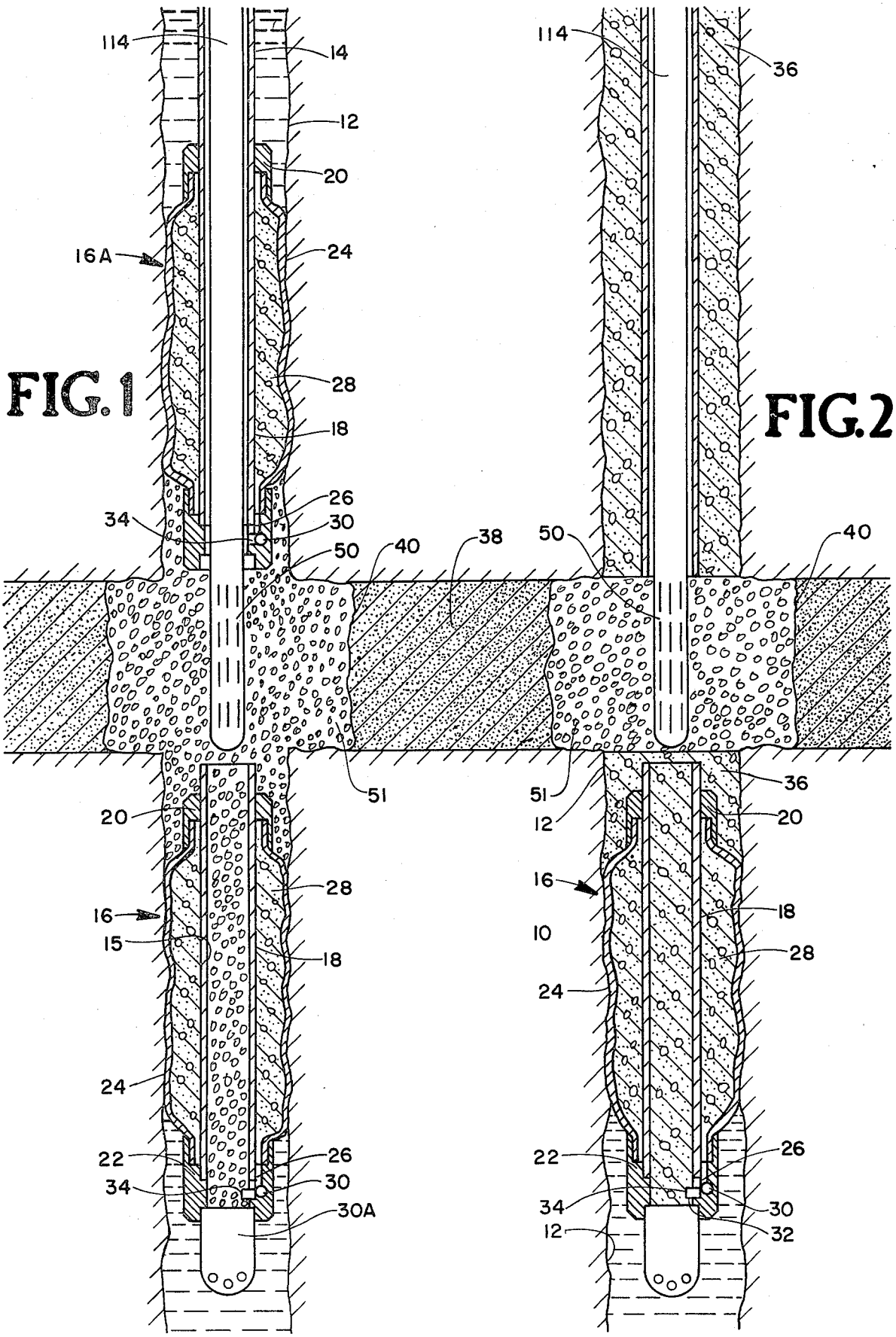
FIG. 1 illustrates a partial section of a subsurface formation intersected by a well bore and with the well being completed in accordance with principles of the present invention illustrating the use of two inflatable packers to seal the borehole below and above the zone of interest.
FIG. 2 is a second use of the invention wherein one inflatable packer assembly is being used to plug the borehole below the zone of interest, the borehole above the zone of interest and around the casing being sealed by conventional well cement.

Referring now to the drawings and first to FIG. 1, there is shown a typical earth formation 10 which is intersected by means of a well bore 12 which extends from the surface and intersects one or more zones of interest, which are also referred to as production formations. An inflatable packer, which is illustrated generally at 16*a*, typically comprises a mandrel 18 which can be provided by a length of casing that extends in sealed and slidable relation through an upper connector assembly 20 and which is interconnected with a lower connector assembly 22. A radially expansible resilient sleeve 24 extends between and is connected to the upper and lower connector assemblies 20 and 22 so as to be, in effect, sealingly connected at its ends to the mandrel. The sleeve may be of rubber or other suitable flexible and elastomeric material, which in its contracted position, is of somewhat larger outer diameter than the mandrel but which, when expanded, forcibly engages the face of the borehole. During drilling operations, lateral shifting and vibration of the drill bit typically causes the well bore to be defined by small roughened or grooved sections. It is intended that the flexible sleeve be capable of being deformed into the surface imperfections of the borehole thus establishing a firm interlocked and sealing relation therewith upon application of sufficient pressure to so deform the sleeve.

Packer 16 can be run into the well on a running string of pipe (not shown) to which it is releasably connected. Expansion of the sleeve is accomplished in accordance with this invention by forcing well cement down through the running string and through a flow passage 26 of annular configuration into the annulus 28. The flow of cement from the casing through the flow passage 26 is controlled by means of a check valve 30 that prevents return of uncured cement from the sleeve annulus and thus maintains sealing engagement of the sleeve against the borehole during and after hardening of cement within annulus 28. A flow passage 32 establishing communication between the interior of the mandrel and the flow passage 26 across the valve 30 is closed by a plug 34. A suitable conventional cementing plug will be inserted into the running string and pumped downwardly through the string by cement on top of the cementing plug. As the cementing plug passes the plug 34, the plug 34 will become sheared by the cementing plug, thereby allowing communication of well cement to the flow passage 26. Thereafter, well cement will fill the sleeve annulus 28 thereby expanding the sleeve radially into positive anchoring and sealing relation with the wall surface of the borehole. The cementing plug will come to rest on shoe 30*a*, and with the cement on top of it, will effectively form a plug to prevent flow through the packer.

After the running string has been removed from the well, the casing string 14, with the inflatable packer 16 interconnected therewith is run into the well, thus positioning the inflatable packer above the zone of interest at the proper height within the well bore. Conventional well cementing slurry 36 if required, is then circulated into the well bore with the packer in the collapsed condition thereof, thus allowing the cement slurry to flow upwardly past the packer to a suitable height for proper well cementing practices. Next, fast setting well cement is then introduced into the casing 14 and is pumped downwardly by means of appropriate plugs, which plugs cause shearing of the closure plug member 34, thus opening communication into the flow passage 26 and the sleeve annulus 28 across the check valve 30. An appropriate amount of pressure may be applied to force the sleeve 24 into tight anchoring engagement with the wall surfaces of the well bore. This pressure is sufficiently great to deform the elastomeric material of the sleeve into the surface imperfections of the borehole that are created during drilling the pressure being maintained by check valve 30 during and after hardening of the cement within annulus 28 so as to form an immediate and permanent seal between the pipe and borehole. Thus, the borehole is quickly and efficiently sealed off so as to prevent communication between the zone of interest and other zones along the borehole.

FIG. 2 illustrates an alternate method only differing from the method described above by the use of conventional casing cementing procedure in place of the upper packer to seal around the bottom of the casing.

Thereafter, for either method, the borehole through zone of interest 38 is underreamed as at 40 to enlarge the diameter to the extent necessary for conventional gravel packing. Conventional screen 50 being interconnected with pipe 114 is lowered within casing 14, pipe 114 then being suspended from the surface so as to position screen 50 within the producing formation. The annulus 51 between the enlarged borehole and the screen is then gravel packed in a conventional manner so as to hold back the formation thus allowing fluids produced from the formation to low through the gravel, through the screen and up pipe 114 to the surface.

It is therefore apparent that the present invention is one well adapted to attain all of the objects and advantages hereinabove set forth, together with other advantages which will become obvious and inherent from a description of the method and apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

The invention having been described, what is claimed is:

1. In a well having an open borehole with a formation which is to be isolated from a lower portion of open borehole, the method comprising:

running a string of pipe into the open borehole with an inflatable packer releasably attached to the lower end of the string;

positioning the packer at a desired depth below said formation to be isolated;

the packer having a radially expansible resilient sleeve sealingly connected at its ends to an interior mandrel and having passage means for permitting flow of fluid to the exterior of the mandrel into the interior of the sleeve;

preventing flow through the mandrel into the open borehole below said packer prior to passing cement through the pipe;

then passing cement down through the pipe string and into the mandrel with flow into the open borehole therebelow prevented through said passage means into said sleeve in an amount and under a pressure sufficient to expand the sleeve in an amount and under a pressure sufficient to expand the sleeve outwardly into tight gripping engagement with the wall of the borehole to anchor the packer to the wall of the borehole above said open borehole; and permitting the cement within the sleeve to set, and detaching the running string from the packer and removing the running string of pipe from the borehole leaving the packer in position therein to act as a plug to isolate said formation from the open borehole below the packer.

2. The method of claim 1 including:

running a string of casing into the borehole and positioning the lower end of the casing at said formation;

cementing at least the lower portion of the casing to the borehole; and producing said formation.

3. The method of claim 2 including:

underreaming said formation at a level below the lower end of the casing.

4. The method of claim 3 including:

gravel packing at least the underreamed portion of the formation.

5. The method of claim 1 including:

running a string of casing into the borehole with a second inflatable packer connected thereto;

the second packer having a radially expansible resilient sleeve connected at its ends to an interior mandrel and having passage means for permitting flow of fluid from the interior of the mandrel into the interior of the sleeve;

positioning the second packer in the borehole above the formation previously isolated by the first inflatable packer;

preventing the flow of fluid through said mandrel below said second packer prior to passing cement through said casing;

passing cement down the casing through said passage means into said sleeve in an amount and at a pressure sufficient to expand the sleeve outwardly into tight gripping engagement with the wall of the borehole; and producing said formation.

6. The method of claim 5 including:

underreaming said formation at a level below said casing and the inflatable packer connected thereto.

7. The method of claim 6 including:

gravel packing at least the underreamed portion of the formation.

8. The method as claimed in claim 1, including the further steps of:

running a string of casing into the borehole with a second inflatable packer connected adjacent the lower end thereof;

positioning the inflatable packer in the borehole above the formation previously isolated by the first inflatable packer;

initially preventing the flow of fluid to inflate said second inflatable packer;

circulating cement down said casing and at least a portion of the way up the annulus between the casing and the borehole;

preventing the flow of cement out of said casing below said packer and allowing the flow of fluid to inflate said second packer;

and inflating said second packer with cement to expand said second packer into tight gripping engagement with said borehole.

* * * * *